US007367068B2

(12) United States Patent
Huff

(10) Patent No.: US 7,367,068 B2
(45) Date of Patent: May 6, 2008

(54) OVERHEAD SUPPORTED HAMMOCK BED

(76) Inventor: John Huff, Electron Audio-Video, 52 N. Third St., Fairfield, IA (US) 52556

( * ) Notice: Subject to any disclaimer, the term of this patent is extended or adjusted under 35 U.S.C. 154(b) by 0 days.

(21) Appl. No.: 10/062,213

(22) Filed: Jan. 31, 2002

(65) Prior Publication Data

US 2003/0140417 A1 Jul. 31, 2003

(51) Int. Cl.
*A47F 3/22* (2006.01)
*A47F 3/24* (2006.01)

(52) U.S. Cl. ..... 5/120; 5/121; 5/127; 472/118

(58) Field of Classification Search ..... 5/120, 5/122, 127, 121; D6/386, 387; 297/373; 472/118, 125

See application file for complete search history.

(56) References Cited

U.S. PATENT DOCUMENTS

| | | | | | |
|---|---|---|---|---|---|
| 523,337 | A | * | 7/1894 | Ebert | 5/101 |
| 756,230 | A | * | 4/1904 | Goddard | 5/127 |
| 894,008 | A | | 7/1908 | Ince | |
| 1,173,654 | A | | 2/1916 | Eaton | |
| 1,252,824 | A | * | 1/1918 | Melniker | |
| 1,380,167 | A | * | 5/1921 | Wester | |
| 3,031,688 | A | | 5/1962 | Southwood | |
| 4,002,368 | A | * | 1/1977 | Ortize | 5/120 |
| 4,101,165 | A | | 7/1978 | Hammer | |
| D249,753 | S | * | 10/1978 | Pratt | |
| 4,221,429 | A | | 9/1980 | Wade | |
| D263,663 | S | | 4/1982 | Moreau | |
| 4,550,456 | A | * | 11/1985 | Allen | 5/98.3 |
| 4,567,614 | A | | 2/1986 | Haider et al. | |
| D336,378 | S | | 6/1993 | Kittridge | |
| 5,511,258 | A | * | 4/1996 | Barr, Sr. | 5/104 |
| 5,659,906 | A | | 8/1997 | Nickell et al. | |
| 5,673,444 | A | | 10/1997 | Middendorf | |
| 5,860,175 | A | * | 1/1999 | Saiki | 5/111 |
| 5,898,960 | A | | 5/1999 | Hill | |
| 5,944,381 | A | | 8/1999 | Nguyen | |

* cited by examiner

*Primary Examiner*—Alexander Grosz

(57) ABSTRACT

A hammock/hanging bed with a web stretched across a typically round support frame and supported via tension member lines/rods/material to one or more overhead points. The device is extremely stable and has excellent strength to weight ratio. The web can be drawn taut, without compromising stability or strength, providing the user with an effectively flat, comfortable area to sleep or relax. The invention allows freedom of motion, has aesthetic appeal (and thereby marketing value), is safer than prior art, and is suitable for either a single user or more than one person at a time. Means for disassembly of the hammock/bed into components via connectors such as hinges and/or joints are also comprised by the invention.

30 Claims, 4 Drawing Sheets

OVERHEAD SUPPORTED HAMMOCK BED

BACKGROUND OF THE INVENTION

1. Field of the Invention

This invention relates to hammocks, hanging beds, and the like, and more particularly, to an improved hammock/bed apparatus that may be round in shape and is supported with tension members to one or more overhead support points, thereby providing enhanced stability and structural strength over prior art hammock designs, as well as greater comfort, restfulness, health benefits, and other advantages to the user.

2. Description of Related Art

Prior art hammocks and hanging beds such as that shown in FIG. 1 have been popular for hundreds of years. Yet heretofore, the traditional hammock design has been rectangular in shape and has provided a resting and sleep environment that slopes significantly downward in the middle and upward on the ends and sides. It has not been amenable to structural enhancements that would readily and easily permit the sleeping surface to be both flexible and effectively flat, thereby resulting in greater comfort. In cases where the hammock tension is quite high, less sagging may result, but the high tension introduces even greater instability and markedly increases the propensity for flipping over of the hammock and/or falling out over the edge. Whether tension is high or not, motion of an individual using traditional hammocks is severely restricted, far more so than with an ordinary bed or couch. For two or more simultaneous users, motion, stability, strength and comfort become even more problematic. Still further, the traditional hammock design necessitates at least two support points and is thereby limited in application to environments in which two or more such supporting configurations are possible. In addition, these support points limit human traffic through that space.

Some hammock designs, such as that of Nickell and Law (U.S. Pat. No. 5,659,906) attempt to ameliorate some of the above problems by using more support points and/or spreader rods at either end of the rectangular hammock surface. Other bed designs, such as that of Haider et al (U.S. Pat. No. 4,567,614) utilize an entire upper support structure for the bed surface, and in the case of Haider et al, then support this upper structure from a lower one which stands on the floor. These attempts have been either a minor improvement or none at all for the problems delineated above.

There is therefore, at present, no hammock or hanging bed device that is comfortable, strong, and safe, and that allows an effectively flat, yet stable, surface upon which to rest or sleep. There is further no such device which utilizes less than two external support points.

OBJECTS AND ADVANTAGES OF THE INVENTION

Accordingly, several objects and advantages of the present invention are to provide superior stability, strength, and comfort for hammocks and/or hanging beds. A further object and advantage comprises an effectively flat, though flexible, hammock sleeping surface, thereby allowing unrestricted motion while sleeping or relaxing. This and other aspects of the invention discussed below provide significant health benefits and advantages over prior art hammock configurations. An additional object and advantage of the invention is its suitability for accommodating more than one individual at a time for sleeping, resting or intimacy without restriction of movement or discomfort. Yet another object and advantage in some embodiments comprises a reduction in total number of hammock support points to one. A still further object and advantage of the present invention is its inherent aesthetic appeal, and therefore its marketing advantage, over prior art hammock designs.

Further objects and advantages of the invention will become apparent from a consideration of the ensuing description of it.

SUMMARY OF THE INVENTION

The present invention solves significant problems associated with prior art hammocks, beds, and hanging beds. It does this by mounting the resting surface (web) on an effectively circular, oval, or similar shape support frame, attaching tension members (lines or rods) to this support frame, and terminating the tension members at one or more overhead support points.

The invention comprises a resting surface or web mounted on a support frame wherein tension members are attached at one end to the support frame and at the other end to one or more overhead support point(s). In a preferred embodiment the support frame is effectively round, i.e., circular, nearly circular, oval, or nearly oval.

The invention in some embodiments may further comprise a single overhead support point. In other embodiments the support point(s) may be part of a tripod, teepee, or other such structure, and/or means may be employed whereby the tension member attachment at the support frame automatically maintains the tautness in the web. In still further embodiments, means for easy assembly and/or disassembly are provided.

The invention, in its various embodiments, solves many of the problems associated with prior art in a superior and wholly satisfactory manner.

DETAILED DESCRIPTION OF THE INVENTION

Previous art hammock designs have not provided stability, comfort, strength, unrestricted movement, applicability to certain environments, or suitability for more than a single person at a time. The present invention, in different embodiments, involves an alternative methodology, which solve these and other problems associated with prior art.

Figure 1:
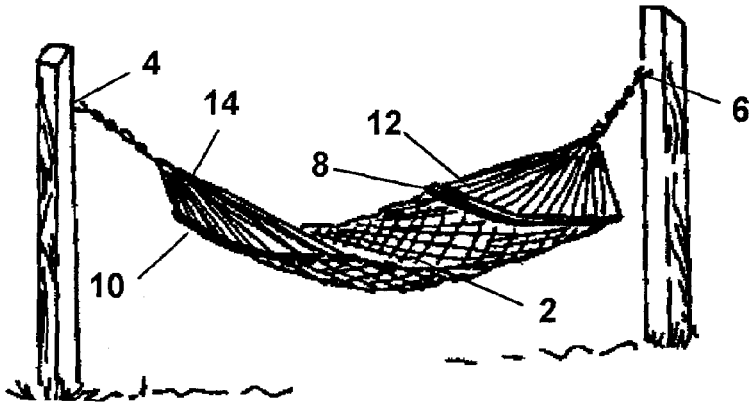
Figure 1. Prior Art
FIG. 1 depicts the traditional hammock/hanging bed design.

FIG. 1 shows the traditional prior art hammock design with rectangular web 2 and support points 4,6 at either end. Spreader rods 8,10 may or may not be used in the traditional design.

Figure 2:
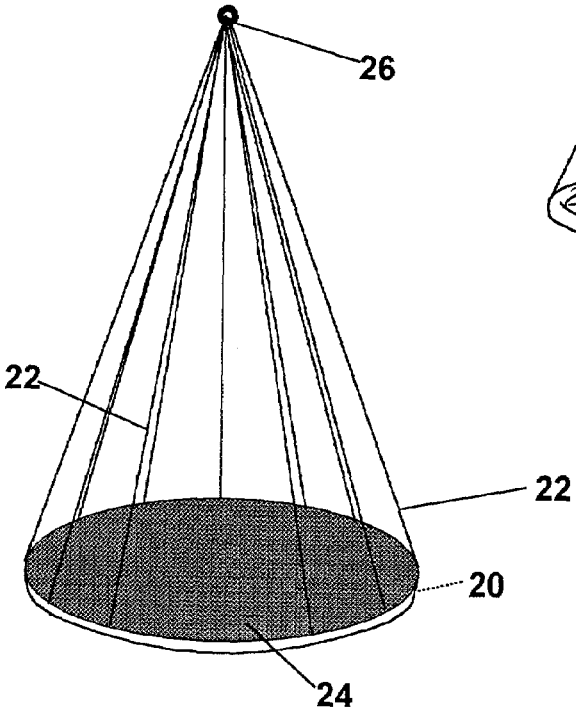
FIG. 2 illustrates the present invention in the preferred embodiment.

FIG. 2 illustrates the present invention in its preferred round support frame 20 embodiment. The web 24 is attached (mounted) to the round support frame 20 to form an effectively circular resting/sleeping area. Tension members 22 of flexible line or rigid rod construction are then connected at one end to various places on the support frame 20 and on the other end to support point 26. In the preferred round support frame embodiment (as well as in oval embodiments), multiple sleep orientations of the user(s) with respect to the bed, or the compass directions, are readily allowed.

It can be advantageous to have the tension members 22 of sufficient number and sufficiently closely spaced to keep the occupant(s) from falling out, during sleep and/or even under potentially extreme angles of inclination. Such number and spacing of tension members 22 are not necessary for the invention, but comprise an embodiment of the invention with enhanced safety and advantage.

Unlike prior art, the web material may then be drawn quite taut so that it does not slope down uncomfortably in the middle without compromising stability and strength. In prior art designs such as that of FIG. 1, tightening of the support tension members 12, 14 led to marked instability, i.e. a propensity for the hammock to flip over or for the occupant to fall over the side. In addition such tightening in prior art designs added to the force in the support tension members 12,14 and the support points 4,6 meaning that less weight could then be held by the hammock. Both the reduction in weight carrying capacity and the decrease in stability severely compromise safety. Still further, such tightening still did not make web 2 effectively flat or completely comfortable, and it severely limited swinging range.

In contrast, the present invention permits the web 24 to be drawn very tightly, with no loss in weight carrying capacity of the support tension members 22 and with no reduction whatsoever in stability. The result is a far more comfortable resting surface (web) for the occupant than can ever be attained in the traditional hammock design, and with no compromise in safety. Aside from the safety and comfort advantages of a taut web, the invention actually is, in its essence, safer than the traditional hammock. The instability conducive to flipping so prevalent in the traditional hammock is all but eliminated. Further, by having support tension members 22 placed appropriately around the web, such support tension members prevent the occupant from rolling out of the hammock. These are significant and inherent advantages over prior art.

Prior art hammocks, cots, and the like, due to the sagging in the middle, are not conducive to health. Prolonged periods, such as during sleep, spent in such hammocks contort the human body into positions that are not healthy for the spinal column or other human physiologic components. In contrast, the present invention permits resting and sleeping in a flatter, and far healthier, position.

Further, intimacy between two human beings is encumbered and problematic in traditional hammocks. In contrast, the present invention allows the full range of movement and positioning, as well as creative exploration of new modalities not possible in normal bedding milieus.

Additionally, the invention can be safely used for play by occupants, either singly or in groups. The freedom to swing in all directions, rather than simply back and forth, is enjoyable for children and adults alike. It can be made to move in either an exhilarating, robust fashion, or far more tranquilly than traditional hammocks.

Still further, the inventor is experienced in hatha yogic practices and has found benefits from the present invention similar to those in yoga. With proper use, the invention achieves results much like those of yogic headstands, inversion boots, and other techniques long known to produce rejuvenative effects, by stimulating blood and fluid circulation, rocking joints into realignment, and other means. It does this naturally, automatically, and easily over time via motions experienced by persons using the invention. For yoga or general exercise use, the swinging or rocking motion of the user may be latitudinal, longitudinal, and vertical (all three directions), and not just in two directions (vertical and latitudinal) as with a traditional hammock.

In any embodiment (though particularly in the round support frame embodiment) the entire web can be easily re-oriented to permit sleep in any compass direction. (Some ancient disciplines such as yoga or Feng Shui claim different specific sleep orientations relative to the Earth's magnetic field and orbit result in specific health and physiological benefits.) Similar easy re-orientation can provide better room light, view, and/or observational angle (for practical or esthetic reasons.)

The inventor has also noticed a simulated feeling of floating provided by the invention that is enjoyable, even blissful, and that appears to result in pleasanter dream states.

In addition, the invention can be hung in many locations that would be impossible for a traditional hammock. For storage or part time use, the invention can be raised (via a rope for example) and stored flat against the ceiling and out of the way. For elevating or hoisting the invention, a flexible tension element could be pulled through an overhead pulley, hook, yoke or similar mechanism and attached to the support point 26. By pulling on the other end of this flexible tension element one could then raise the invention vertically and out of the way. It could, for example, be stored against the ceiling, thereby freeing room space for other activities. Any number of flexible tension elements may be used to raise the invention in this manner.

Further, the round shape of support frame 20 creates truer omnidirectional pendulum motion (real & perceived), due to more even weight distribution. It is also easier to roll over in (in all embodiments), because the bed moves under the occupant's rolling mass. This may be useful for the aged and infirm.

The circular nature of support frame 20 provides superior structural strength with minimum weight. Circular shapes, like arches, are inherently stronger than alternatives. The web 24 can therefore be pulled extremely tightly without the necessity of excessive bulk in the support frame 20. Further, the force in the tension members 22 is unaffected by the degree of tautness in the web 24. These factors, resulting from the effectively circular (round) shape of the support frame 20, allow the device to be light and relatively portable. It does not necessarily have to be built of heavy material to be strong, or to retain its inherent advantages over prior art hammocks and beds. In addition, use of multiple tension members 22 in any embodiment allows the support frame 20 to be lighter yet still structurally sound.

In this or any embodiment the resting surface 24, termed a web herein, could comprise a mattress, foam or similar material. Alternatively, a mattress, foam, or similar material could simply be supported by a web 24.

Also, an embodiment of the invention with practical advantage would comprise at least three tension members attached to the support frame or web at more or less equally separated locations. We may choose any point as a 12 o'clock position on the support frame, and attach a tension member there. We may then consider a second point at approximately 4 o'clock, say within the region of 3 o'clock to 5 o'clock and attach a tension member thereto. We may then attach a tension member to a point on the support frame or web between 7 o'clock and 9 o'clock. Such a configuration will provide stable support for the support frame and any human occupants residing on the web.

Figure 3:
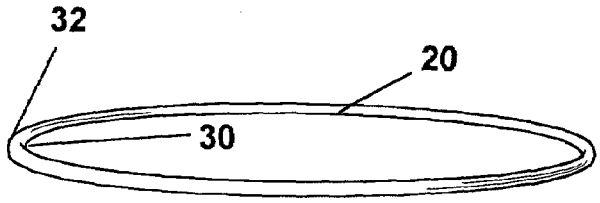
FIG. 3 shows the torus shaped configuration for the support frame.

FIG. 3 shows a shape for the support frame 20 of that of a torus. Though the toroidal shape has many strength and stability advantages, the invention is not limited to a support frame 20 of such a shape. The support frame could be any of a number of alternative non-round shapes with non-circular cross sections and still be comprised by the invention. Note that in FIG. 3 the inner periphery 30 is defined by the inner diameter of the torus. The outer periphery 32 is defined by the outer diameter of the torus. In non-toroidal shapes the inner periphery is defined by that continuous set of points on the support frame which is nearest the centermost point of the support frame area (effectively the centermost point of the web.) The outer periphery is defined by that continuous set of points on the support frame which is furthest from the centermost point of the support frame area.

In one embodiment of the invention, at least some tension members are not connected to the outer periphery, such that a bed sheet can wrap around the outer periphery, yet remain for the most part inside the tension member(s), contact both the web and the outer periphery, and be held fast between this juncture.

Figure 4:
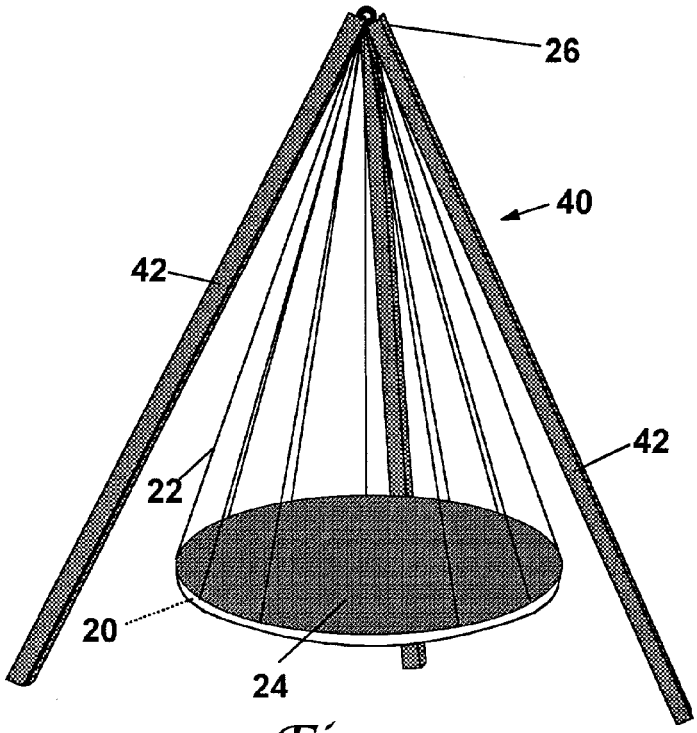
FIG. 4 depicts an embodiment of the present invention wherein a tripod support structure is employed to provide an overhead support point.

FIG. 4 depicts an embodiment of the invention that utilizes a tripod stand 40 to which the tension members 22 are attached at support point 26. The legs 42 of the tripod may be joined together at support point 26 and rest on the ground or floor. Such legs 42 may also be linked to one another via chains, lines, or rigid structures to enhance stability. The tripod can be portable and collapsible, or fixed.

The invention may, of course, also be hung from a tree or tree branch, a ceiling, a beam, or any other suitable overhead structure.

Figure 5:
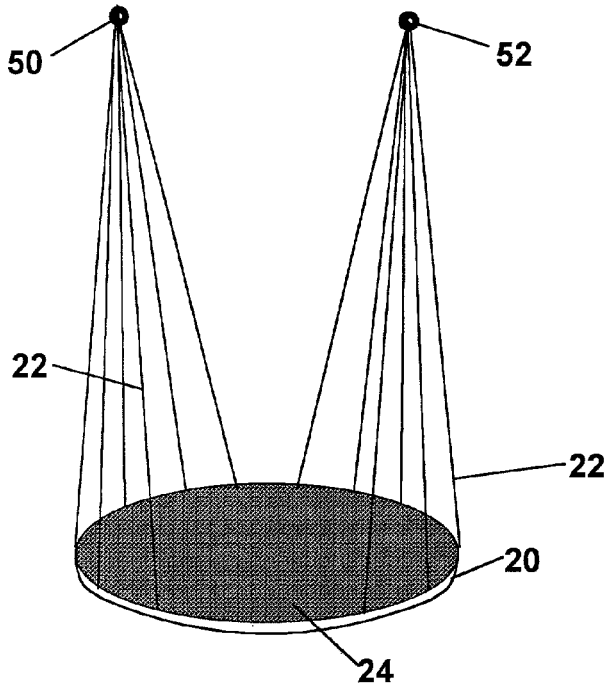
FIG. 5 shows an embodiment of the present invention having two overhead support points.

FIG. 5 illustrates an embodiment of the invention with two, rather than one, support points 50 and 52. Any number of support points may be used and still comprise the present invention.

Figure 6:
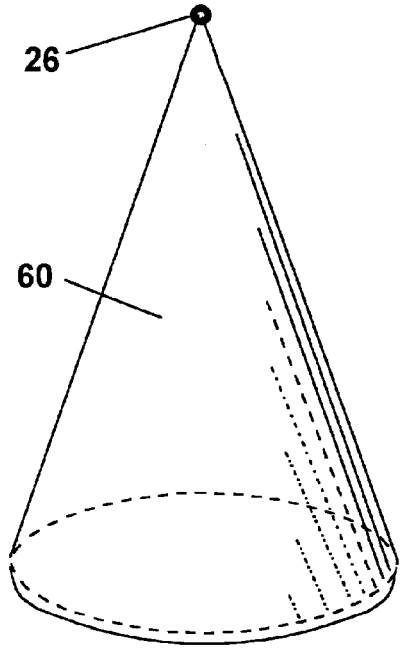
FIG. 6 shows an embodiment of the invention employing a continuous tension member.

FIG. 6 shows another embodiment of the invention in which the support frame 20 is held aloft via a continuous material tension member 60. In this embodiment the continuous material tension member 60 carries the load of the weight from the support frame 20 and the occupants positioned on the web 24. The continuous material tension member 60 may also function much like a tent, umbrella for rain/sun protection, or a mosquito net, depending on its composition. The continuous material tension member 60 may therefore be mesh-like netting or truly continuous like tent or umbrella material. There may also be more than one continuous material tension member, each connected to a section of the support frame 20 or each connected to most or effectively all of the entire 360° around the support frame 20.

In other embodiments, the tension members 22 may be a number of individual lines or rods (rather than a continuous material) with a continuous material employed in conjunction with them to serve as a tent, umbrella, mosquito net or the like.

Figure 7:
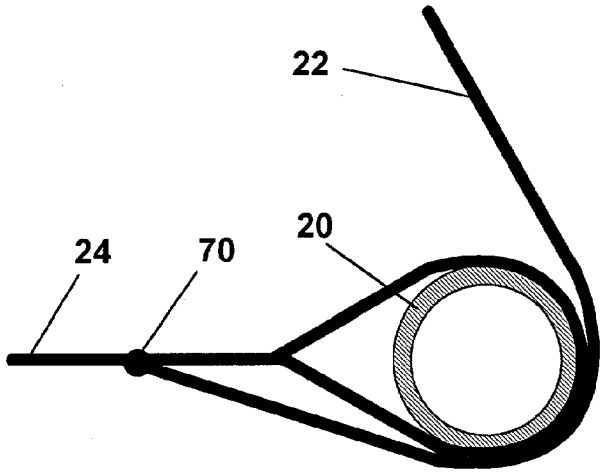
FIG. 7 shows a self tightening configuration for keeping the web taut.

FIG. 7 shows a means to keep the web 24 "self taut". The web material is extended around the support frame 20 (shown as a circular cross section in FIG. 7) and attached back to itself in any suitable fashion. Tension members 22 (or continuous material tension member 60) are brought around the outside of the support frame 20 and attached to the web 24 at tightening point 70. When weight (such as a person) is added to the web 24, additional force occurs in tension members 22 (or in the continuous material tension member 60). This additional force is transmitted through the tension member 22 (60) and around the support frame 20 where it results in an outwardly directed (rightward in FIG. 7) tensioning force on tightening point 70. Hence, the configuration depicted in FIG. 7 results in self tightening of the web 24.

Figure 8:
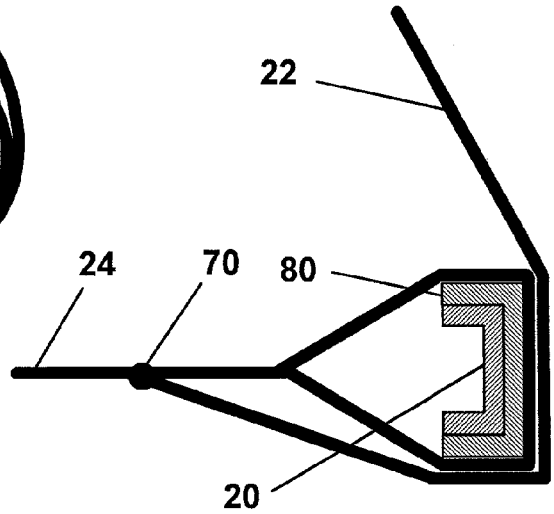
FIG. 8 illustrates a self tightening configuration for keeping the web taut for an alternative support frame cross section.

FIG. 8 illustrates the same self tightening means as FIG. 7 with support frame 20 comprised of a C channel beam rather than a circular cross section. The particular cross section of the support frame 20 is not relevant to the means shown for self tightening in FIGS. 7 and 8, or for the invention in general. In FIG. 8 padding 80 (foam or other suitable material) is optionally employed, but that is not necessary to the invention and merely comprises an additional embodiment. A padded support frame (wrapped in soft and/or resilient material) serves to cushion the interaction of the invention with other objects or people, an important optional feature for a device in motion.

The self tightening means described above does not have to achieved by leading the tension members 22 around the outer periphery 32 (FIG. 3) and underneath the support frame 20, but instead such tension members may pass directly through holes in the support frame 20. Alternatively, such tension members 22 may pass through external fixtures (such as eye bolts or hooks) on support frame 20 or through flanges or other extensions of, or attached to, support frame 20. With such means, the tension members 22 may even pass above the support frame 20 or via the inner periphery 30.

With the tension members 22 passing around, or attached either directly or indirectly to, the support frame 20, a significant additional advantage is achieved. Sheets, blankets, mattresses, pads, and/or anything that needs to be securely attached or held stable relative to the bed can be tucked into the area between the tension member and the frame, and held tight by the tension there. This is an important advantage, especially in a bed that may be in motion. This advantageous feature is not shared by prior art hammocks or vertically supported devices.

Tension in the web 24 does not have to be achieved/maintained by the means shown in FIGS. 7 and 8, but can be done by any possible means. One such means comprised by the invention utilizes tightening cords stretching from the support frame 20 to points on the web 24. An elastic web material that is pre-shaped to fit over the support frame can instead, or also, be used in other embodiments.

For the purposes of the present invention the term "tautness index" of the web 24 shall mean the ratio of the average inner diameter (or, for non-circular support frame embodiments, the average inner dimension distance) of the support frame 20 divided by the depression distance at the center of the web 24 from a reclining and motionless 6 foot tall person weighing 175 pounds. For example, for a 1 foot depression at the center of a 7 foot inner diameter support frame from such a person, the tautness index would be 7. The present invention in many embodiments can readily be configured to possess superior tautness indices of 7, 10, 15, 20, 25, 30 or better for a 7' diameter circular frame.

The invention comprises any possible cross section, as well as any possible shape, for the support frame 20. The support frame shape can be round, oval, approximately round, approximately oval, heart shaped, approximately heart shaped, square, triangular, rectangular, trapezoidal, octagonal, or any other polygon. In particular, a triangular shape has certain well recognized structural advantages (similar to those of round/circular shape) over rectangles, trapezoids, or other polygons. Hence, a useful embodiment of the invention comprises an effectively triangular shape for support frame 20, which may be continuous in nature or composed of sections (typically three "legs" of the triangle).

Figure 9:
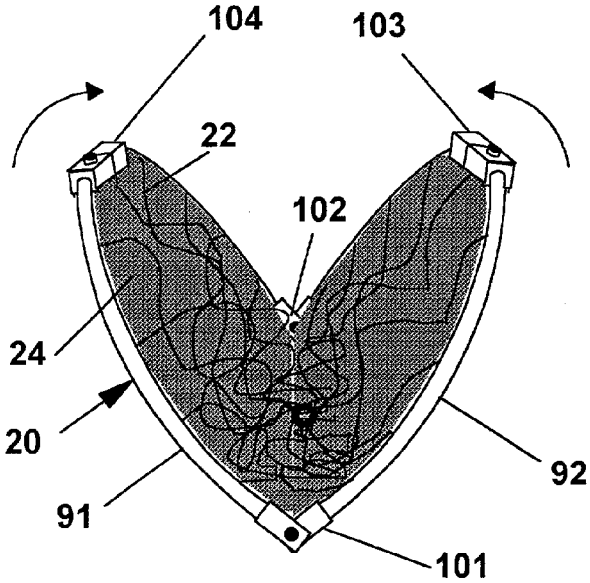
FIG. 9 depicts another embodiment of the present invention comprising an easy to assemble/disassemble configuration.
Figure 10:
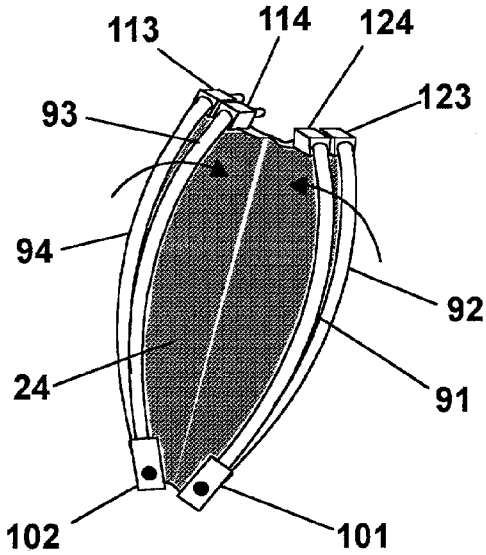
FIG. 10 displays a subsequent stage of disassembly from that of FIG. 9.

FIGS. 9 and 10 show a collapsible embodiment of the present invention as embodied in a round support frame configuration. As noted previously, other than round shapes for the support frame 20 are comprised by the invention, and the means for collapsing the support frame described herein may be employed in any of these alternative shape configurations as well. In FIGS. 9 and 10 the support frame 20 is comprised of four sections (though any number of such sections are comprised by the invention) 91, 92, 93, 94. Each end of each section is connected via a connector (such as elements 101, 102, 103, 104) to another section. Such connector may be a hinge forming a flexible joint between sections, a socket joint between sections which may be disconnected, or any other possible type connector. With the connectors locked in place the sections are joined and form a rigid support frame 20. The connector locking can be released such that the support frame is no longer rigid but folds up into sections as shown in FIGS. 9 and 10. Such capability for folding up of the support frame 20 provides considerable benefit for storage, transportation, shipping, and disassembly of the invention. For the purposes herein, such capability shall be referred to as meaning the support frame can be made to occupy less space.

In FIG. 9 the support frame 20 in one embodiment of the invention is shown being folded up in half. The connectors 101 and 102 are hinges which are released to swing freely such that two half sections of the invention are folded together. Connectors 103 and 104 in FIG. 9 are shown as hinge connectors, though they may be socket joints or other type connectors that may permit disconnection of the two sections each joins. In FIG. 10, socket joints are shown in lieu of swing hinge connectors 103 and 104. These socket joints each have two components. 113 (male) and 123 (female) are the components of one of the socket joint connectors. 114 (male) and 124 (female) are the components of the other socket joint connector. Note that in FIG. 10 the socket joints are disconnected and thereby allow the invention to be folded again. This results in a storage or packing area (called "surface area" herein) for the invention of much smaller than one fourth that of the fully assembled invention (which in the embodiment of FIG. 2 is a circular surface area). Alternatively, the socket connectors in FIG. 10 may instead be hinges, such as 103 and 104 of FIG. 9. In that case, the invention could likewise be folded up to less than one quarter surface area in size via swiveling about the hinges 103 and 104 rather than via disconnecting of the socket joints.

Note that the disassembled configuration of FIG. 10 can pack into significantly less surface area than 25% of the fully assembled device of FIG. 2. This is because the web 24 can be folded in toward the sections 91, 92, 93, 94. Hence the surface area of the disassembled configuration could be a small as 10 or 15% of the fully assembled device.

Although hinged joint connectors are shown in FIG. 9 and socket joints in FIG. 10, any suitable connection(s) between sections of the support frame are comprised by the invention. Typically the sections such as 91, 92, 93, 94 are arcuate, i.e., of arc-like or bowed shape, though that is not necessary for the invention. They may be straight or of any other suitable form. Although such sections are shown in FIGS. 9 and 10 to be four in number, any number n is comprised by the invention. The number of sections n may be two, three, four, five, or more. Connectors may be articulating (enabling motion thereof between connector parts such as hinges 101 and 102) or non-articulating. Non-articulating, as used herein, means fixed and non-moving between parts, except that in some embodiments parts of non-articulating connectors may be detached as, for example, elements 113 and 123 in FIG. 10.

Figure 11:
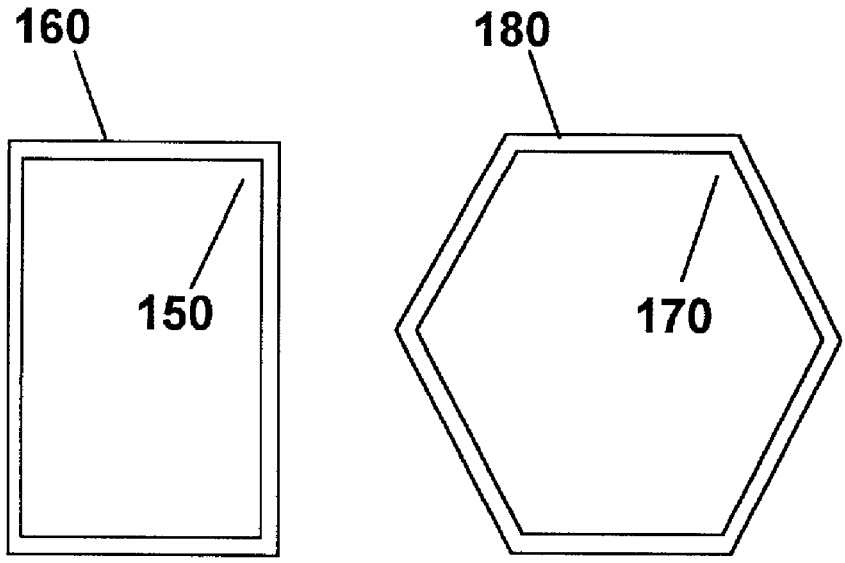
FIG. 11 illustrates the types of support frame shapes comprised by some embodiments of the invention.

The invention also comprises a kit wherein the invention is disassembled, either as that shown in FIGS. 9 and 10, described specifically herein, and/or otherwise. The invention could be shipped in the disassembled state to an end user who could then assemble it simply by fastening the connectors rigidly. The kit could consist of two or more arcuate, straight, or other sections, joined by any combination of fixed or articulating hinge or other connectors, such that a rigid hoop frame could be assembled to hold taunt a web and be supported by tension members as described herein. A preferred embodiment of the kit would be two hinged joints and two to four insert (socket for example) joints. The two hinged joints would facilitate final web tensioning or quick bed relocation without total disassembly, whereas the other joints would allow the device to be packaged into a relatively small container or area for ease of transport and installation. The kit would also allow the preparation, assembly, and attachment of most of the device elements (web, tension members, etc. to the frame, top connector yoke, and each other) to be done at the factory by trained workers, if desired. Otherwise, a raw kit consisting of most or all of the basic unassembled elements could be received by the user, and he, she, or an agent thereof could perform these tasks. For the purposes herein we define a class of shapes, termed "select shapes", for the support frame 20 which have certain structural, manufacturing, assembly/disassembly, and use advantages. These select shapes comprise those polygons having at least one interior angle between component sections of greater than 90 degrees. This distinction is displayed in FIG. 11. The interior angle 150 in the rectangular shape 160 is equal to 90 degrees. The interior angle 170 in the hexagonal shape 180 is 120 degrees. Hence, the hexagon 180 is a select shape, whereas the rectangle 160 is not. We note carefully, that circles, ovals, egg shapes, and similar shapes are limiting cases when the number of sections approaches infinity, are comprised by the term select shapes, and have interior angles all along their peripheries of 180 degrees. Squares, rectangles, and triangles are not comprised by the term select shapes. A shape wherein a portion of said shape is an arc and one or more other portions are not arcs may or may not be a select shape depending on whether or not any interior angles therein are greater than 90 degrees.

Figure 12:
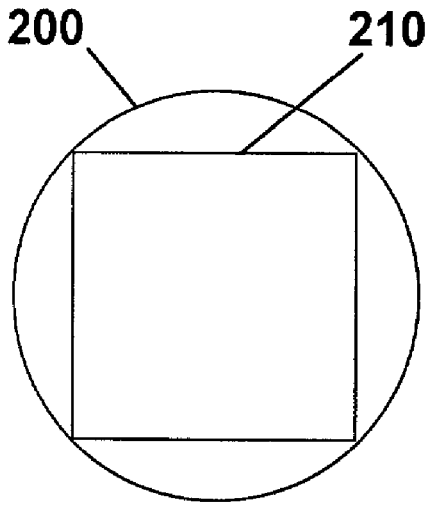
FIG. 12 illustrates another way of distinguishing suitable support frame shapes from less suitable shapes.

FIG. 12 helps in describing another way of defining support frame shapes which are similar in many ways to the select shapes described in the foregoing paragraph.

One objective of the invention is to provide a maximal area for humans to recline, yet take minimal space in the room or other location where the invention is located. This permits use of space in a potentially less intrusive, obstructive, or otherwise problematic way. The invention, when hanging statically, may turn in a horizontal plane (about a vertical axis) and in so doing sweep out (i.e., over) an area. For a rectangle, for example, the area swept out will be greater than the area of the rectangle. For a circle, the area swept out will equal the area of the circle.

For minimal space usage with maximal reclining area, a user of the invention would prefer the circle rather than the rectangle. However, other possible shapes than a circle, including many different polygons, are comprised by the invention and many of these shapes provide greater advantage in this regard than a rectangle or square. With the aid of FIG. 12, we therefore define such shapes as follows.

The circle 200 of radius r of FIG. 12 has internal area $\pi r^2$. The square 210 inscribed in that circle has internal area $A=2r^2$. The ratio of the two is $\pi/2$ or slightly more than 1.57 (=157%). The area swept out by the square as it rotates in the horizontal plane equals the internal area of the circle and is more than 157% of its own internal area A. We define a class of support frame shapes comprised by the invention as those shapes with internal area A whose area swept out by rotation in the horizontal plane is less than 157% of A. We can, of course, also define other classes of support frame shapes of internal area A that sweep out areas which are other percentages of A. By way of example but not by way of limitation, an other class of such support frame shapes could also sweep out areas less than 120% of A.

The corners or protuberances of many prior art hammock designs can bump into walls, furniture, the support frame, people, or other objects, and thereby create a nuisance, hazard, and/or limit to the free swinging area swept. This problem becomes less severe as the frame shape approaches circularity. Hence a polygonal shape of n sides, where n is greater than 4, has advantage in this regard over a rectangular shape, and such polygons are comprised by the invention.

A high degree of web tension is very desirable, yet over time many common types of web 24 material, such as hammock rope or fabric mats, will stretch. The hinged joint embodiment of FIG. 9 has the additional benefit over prior art of permitting easy re-tensioning of the web 24. To do this, the user first quickly de-tensions the web 24 by folding in the hinges. This allows the surface's apparent cross-sectional area to be easily reduced by a variety of means, for example by shortening the attachment means (typically horizontal net ropes not shown in the figures) for the attaching the web 24 to support frame 20, or by shrinking the cross-sectional area of the web itself, or by other means. Hence, this can be done while the web 24 is not under any tension. The user then unfolds the support frame 20, taking mechanical advantage of the leverage and speed afforded by the effective hinge-arm assembly, restoring it to its original and larger transverse area. In so doing, the tension increases immediately to a very high and sufficiently desirable level. This is of immense advantage over prior art for ease of use and quality of support.

It is readily seen from the above description of the invention that it can be lighter than prior art beds (and therefore potentially less expensive and easier to store or transport), yet stronger, stabler, more comfortable, and usable than traditional hammocks or cots. Further, the stable, relatively large area web 24, by being suspended below the rotational point, has greater angular stability (i.e., lower angle of inclination) under even extreme swinging distance. Additionally, under the most severe angles of inclination, the tension members 22 can be configured to keep the user safely inside. A simple means to test for this is by use of an ordinary basketball placed on the web and by defining a cell to be the region defined by the web and the tension members. The invention thereby comprises configurations of tension member placement such that when the web is held at a 45 degree angle with respect to horizontal, the basketball is captive within the cell and can not roll outside of the cell and onto the floor.

In the present invention the user(s) are effectively closer to the center of gravity than in prior art hammocks or cots. Weight is centralized and better distributed.

The tension members may be positioned such that a portal, or access opening, is provided to permit easy entrance to and exit from the web.

One way to summarize a preferred embodiment of the invention is as follows. It comprises a support frame having select shape such that an interior angle of said select shape is greater than ninety degrees, a web supported by the support frame, and multiple tension members connecting between i) an overhead point, and ii) multiple points on the support frame, the web, or both. Of course, in other embodiments the multiple tension members may be replaced by a continuous tension member as in FIG. 6. Another way to summarize the invention is to define the support frame as having an internal area A which is such that rotation of the support frame in horizontal plane sweeps out an area less than $\pi/2$ times A. (See FIG. 12.)

Yet another way to view the invention, one which emphasizes a fundamental stability advantage over prior art, is that no horizontal force is needed for any support. For example, in FIG. 1, a prior art hammock has horizontal support ropes 12, 14, and those connecting to points 4 and 6. As noted earlier tightening of the tension on these support ropes leads to reduced strength and stability. In the present invention such horizontal support force is not needed. Note that we define any support structure with angle closer than 45 degrees to the horizontal plane as having horizontal force. Any support structure (such as the tension members in the present invention) having angle greater than 45 degrees from the horizontal plane is considered to have no horizontal force. Hence we may describe the invention as one where no horizontal force is applied to any support when the apparatus hangs from an overhead point in a static position.

This invention can thus be seen to solve significant problems delineated in the "Description of Prior Art" section presently associated with prior art in a simple and novel manner.

While the above description contains many specific details, the reader should not construe these as limitations on the scope of the invention, but merely as exemplifications of preferred embodiments thereof. Those skilled in the art will envision many other possibilities that are within its scope.

For example any of the embodiments could use any shape, dimensions, cross section, material, or number of separate composite parts for the support frame 20. The inner and outer periphery dimension distances of the support frame 20 could be any dimension, although typically herein we consider six to eight feet for these dimensions as probably most suitable for human use. Any number of tension members 22 (or 60), attached at any number of places to the support frame 20, or web 24, of any length or cross section, and made of any suitable flexible or non-flexible material are also comprised by the invention. The web 24 can be of any material and can be attached to the support frame 20 in any suitable manner. The web 24 can be mesh or non-mesh, and can be a single continuous piece or a combination of composite pieces. The invention comprises a single support point 26 or any number of multiple support points to which the tension member(s) are attached. It further comprises any possible overhead structure containing the support point(s) and any possible means of support or attachment As used herein the words "round", "circular", "oval", "triangular", "polygonal", "toroidal" and the like mean "effectively round", "effectively circular", "effectively oval", "effectively triangular", "effectively polygonal", "effectively toroidal" and etc. "Circle", "triangle", "polygon", "torus" and the like have similar meanings as being in an effective sense. The word effective here can be construed as meaning both approximate and exact.

ADDITIONAL CONSIDERATIONS

1. The invention comprises a frame which has no protruding corners along its outer periphery which can damage walls. In one embodiment, the frame is of sufficient size to accommodate a reclining adult, and it is circular or ovoid in overall shape. A flat support surface spans the frame, and supports the reclining adult. A suspension system supports the frame from a single location, as shown in FIG. 2, wherein tension members 22 support the frame.
2. As the Figures show, the frame can be surrounded by a sheath of padding. This padding provides cushioning along the outer periphery of the frame, much like a padded belt, and protects objects such as furniture and walls from impact with the frame.

Accordingly, the scope of the invention should be determined not by the embodiments described, but by the appended claims and their legal equivalents.

The invention claimed is:

1. A hanging bed comprising:

a) frame means having no protruding corners along its outer periphery which is (1) of sufficient size to accommodate a reclining adult user and (2) circular or ovoid;

b) a substantially flat support surface for supporting the adult user, which surface spans the frame means;

and c) overhead suspension means for supporting said frame from a single location, in which no barrier is present at the periphery of the support surface.

2. Apparatus according to claim 1, wherein the support surface has a tautness index of 7.0 or greater.

3. Apparatus according to claim 1, wherein the frame means is circular.

4. Apparatus according to claim 1, wherein the overhead suspension means comprises tension members i) all of which extend from said single location, and ii) each of which connects to a different point on the frame.

5. Apparatus according to claim 4, wherein the different points are uniformly distributed around the frame.

6. Apparatus according to claim 1, wherein the overhead suspension means comprises tension members i) all of which extend from said single location, and ii) each of which connects to a different point on the support surface.

7. Apparatus according to claim 1, and further comprising a mosquito net which protects an occupant of the bed from mosquitoes.

8. Apparatus according to claim 1, and further comprising an umbrella which protects an occupant of the bed from the sun, rain, or both.

9. Apparatus according to claim 1, wherein at least some of the tension members apply tension to the support surface.

10. Apparatus according to claim 1, and further comprising padding surrounding at least part of the frame.

11. Apparatus according to claim 1, and further comprising a floor stand which provides a mounting support at said single location.

12. Apparatus according to claim 1, and further comprising a hoist for raising the apparatus.

13. Apparatus according to claim 1, and further comprising connector means for disassembly of the frame into a compacted configuration.

14. Apparatus according to claim 13, wherein the compacted configuration occupies half, or less, the surface area of the assembled frame.

15. Apparatus according to claim 13, wherein the compacted configuration occupies 25 percent, or less, of the surface area of the assembled frame.

16. Apparatus according to claim 1, wherein the connector means comprises one or more hinges.

17. Apparatus according to claim 1, wherein the connector means comprises one or more socket joints.

18. Apparatus according to claim 1, wherein the frame has an internal area A, and a shape such that rotation of the support frame in a horizontal plane sweeps out an area which is less than 157 percent of A.

19. Apparatus according to claim 1, and further comprising:

c) a belt of padding surrounding the outer periphery of the frame, which cushions impact occurring when the frame contacts a wall.

20. Apparatus according to claim 1, wherein the support surface is deformable.

21. Apparatus according to claim 1, wherein the frame surrounds an area of at least A square feet, and further comprising:

hinge means for folding the frame into a compacted configuration which can be confined in an area less than half of A.

22. Apparatus, comprising:

a) a rigid frame which is (1) of sufficient size to accommodate a reclining adult user and (2) circular or ovoid;

b) a flat web spanning the frame and having a tension index greater than or equal to 7.0; and c) multiple tension members, i) all connecting to a common support, and ii) each connecting to a different point on the frame, in which no barrier is present at the periphery of the support surface.

23. Apparatus according to claim 22, wherein the different points of paragraph (c)(ii) are uniformly distributed along the rigid frame.

24. Apparatus according to claim 22, wherein the flat web is deformable.

25. Apparatus, comprising:

a) a support frame having no protruding corners along its outer periphery which can damage walls which is (1) of sufficient size to accommodate a reclining adult user and (2) circular or ovoid;

b) a web spanning and supported by the support frame, and having an upper and a lower surface;

c) a plurality of tension members, each having an upper and a lower end, such that i) the lower ends connect to respective points on the lower surface of the web, and ii) the upper ends connected together at a common point at which the apparatus is suspended.

26. Apparatus according to claim 25, and further comprising:

d) a belt of padding surrounding the outer periphery of the frame, which cushions impact occurring when the frame contacts a wall.

27. Apparatus, comprising:

a) a substantially flat support system which i) has an outer periphery which is circular or ovoid in shape;

ii) a deformable upper surface for supporting a reclining adult user; and b) overhead suspension means for supporting said support system from a single location, in which no barrier is present at the periphery of the support surface.

28. Apparatus according to claim 27, wherein the suspension means comprises a collection of tension members, all emanating from said single location, and each running from said single location to a respective location along said periphery, thereby providing uniform support along said periphery.

29. Apparatus according to claim 27, and further comprising:

c) a belt of padding surrounding the outer periphery of the frame, which cushions impact occurring when the frame contacts a wall.

30. Apparatus according to claim 27, wherein the upper support surface cooperates with the suspension means to form a cell such that, when the upper support surface is held at a 45 degree angle with respect to the horizontal, a basketball within the cell is held captive and cannot roll outside the cell and onto the floor.

* * * * *